US008745940B1

(12) United States Patent
Jimenez

(10) Patent No.: US 8,745,940 B1
(45) Date of Patent: Jun. 10, 2014

(54) MULTI-UNIT CONDOMINIUM STRUCTURE WITH CONFIGURABLE SPACE DESIGNS

(76) Inventor: Brian R. Jimenez, Columbus, OH (US)

( * ) Notice: Subject to any disclaimer, the term of this patent is extended or adjusted under 35 U.S.C. 154(b) by 2552 days.

(21) Appl. No.: 11/322,380

(22) Filed: Dec. 30, 2005

(51) Int. Cl.
*E04H 1/00* (2006.01)

(52) U.S. Cl.
USPC ..... 52/234; 52/79.1

(58) Field of Classification Search
USPC ..... 52/79.1, 234
See application file for complete search history.

(56) References Cited

U.S. PATENT DOCUMENTS

| | | | | |
|---|---|---|---|---|
| 3,874,137 | A | 4/1975 | Gentry | |
| 3,996,709 | A | 12/1976 | Coxe | |
| 4,041,661 | A * | 8/1977 | Hurwitz | 52/169.4 |
| 4,341,052 | A | 7/1982 | Douglass, Jr. | |
| 4,573,302 | A | 3/1986 | Caretto | |
| 4,685,260 | A | 8/1987 | Jenn | |
| 6,393,774 | B1 * | 5/2002 | Fisher | 52/79.1 |
| 6,484,454 | B1 | 11/2002 | Everhart | |
| 6,568,134 | B2 | 5/2003 | Kerney | |
| 6,625,937 | B1 | 9/2003 | Parker et al. | |
| 7,540,120 | B2 * | 6/2009 | Miller | 52/236.3 |
| 2003/0056826 | A1 * | 3/2003 | Thomas | 137/360 |
| 2003/0150178 | A1 * | 8/2003 | Bergman | 52/234 |
| 2004/0200132 | A1 * | 10/2004 | Hoshall | 43/124 |
| 2005/0095419 | A1 * | 5/2005 | Raeburn et al. | 428/319.1 |
| 2005/0115166 | A1 * | 6/2005 | Miller | 52/79.1 |
| 2008/0008538 | A1 * | 1/2008 | McClure et al. | 405/229 |
| 2008/0216389 | A1 * | 9/2008 | Hoshall | 43/132.1 |
| 2008/0244998 | A1 * | 10/2008 | Dooley et al. | 52/203 |

* cited by examiner

*Primary Examiner* — Mark Wendell
(74) *Attorney, Agent, or Firm* — Standley Law Group LLP

(57) ABSTRACT

An improved method of constructing multi-family housing units on a shared foundation comprising common structural designs which are each configurable to multiple space floor plan design options. Each design may be comprised of substantially identically positioned service access points offering common datum locations upon which to construct a variety of different space floor plans. This method effectively segregates the need to fix a floor plan prior to installing a foundation, which allows the developer to conform and transform "in process" inventory to match in a more real-time manner, the volume, design configuration, and timing of condominium unit construction to a buyer's desires and current market demand, thus reducing development risk based on otherwise potentially inaccurate market forecasts.

19 Claims, 28 Drawing Sheets

70

90

1ST FLOOR BATH
(ALL KITCHENS)

SECOND FLOOR FULL BATH
(KITCHENS A,C,& D)

SECOND FLOOR 1/2 BATH
(KITCHENS A,C,& D)

MULTI-UNIT CONDOMINIUM STRUCTURE WITH CONFIGURABLE SPACE DESIGNS

BACKGROUND OF THE INVENTION

The present invention relates to the construction of multi-unit condominium structures. Specifically, the present invention is a multi-unit condominium structure constructed using configurable space designs so as to allow a developer the flexibility in the process of constructing the individual condominium units in a more real time manner to meet a specific buyer's changing desires and to meet more effectively buyers' desires and sales demands in general.

Of the various decisions facing a project developer, none is more critical than determining the number and mix of different unit floor plans that should be built in a given area or at a given time. Typically a developer uses economic and demographic principles to forecast the future demand and based on this prediction then commits early on to build specific architectural designs to meet these forecasts. However, the bulk of the units will not be sold until after the construction has commenced or even finished, typically one to several years from the date the developer committed to the mix of units and from the initial date that construction commenced. For purposes of construction, the terms "builder" and "developer" are used interchangeably herein.

A principal problem with this traditional method of development is that it is often difficult, if not impossible, to forecast demand months and years into the future. Changing circumstances, such as a change in interest rates, a change in the local economy, the personal desires of future buyers, or the effects of other competing development projects are unforeseeable at the time that the demand mix is forecasted. Since even the proven economic and demographic methods used to forecast the demand mix are often inaccurate, lacking the ability to accurately predict such extraneous factors forces the developer to select a building structure and floor plans based on the best information available at the time. This approach can incur significant risk in that once the building structure and design mix of units is committed to and fixed and the construction subsequently started, the flexibility to change architectural aspects of the construction is limited and subsequent changes can be difficult and costly. Consequently, this inherent inflexibility to allow structural design changes and significant floor plan changes after a development or building(s) is platted and or construction started severely impedes a developer's ability to rapidly adapt an otherwise less desirable platted or under construction design to a more favorable one desired by a current buyer.

Prior attempts at addressing this problem such as U.S. Pat. No. 6,625,937 to Parker et al., discloses a method of constructing low cost modular housing in a manufacturing facility. The patent discloses the production of standard prefabricated modules that may be arranged in various configurations to produce a variety of floor plans. However, when the invention is used to construct multifamily buildings, the buildings are not arranged based upon buyer demand and the modules are not varied in size or shape. Additionally, the invention does not teach a flexible method by which a design can be changed in a manner to meet current buyer desires.

What is needed is an improved flexible method of constructing multi-family condominium units as well as single family dwellings in a more real time adaptable approach based upon current buyer's desires and demand rather than the traditional method of fixing predetermined architectural structures and floor plan designs to projected requirements based on potentially inaccurate market forecasts.

SUMMARY OF THE INVENTION

The following invention relates to the configuration of at least one space within a condominium structure, which may be part of a larger multi-unit condominium structure. More specifically, through the use of interchangeable space plan layouts or interchangeable interior modules, multiple floor plan configurations are available within the multiple condominium structures all on a common foundation. For example, using a condominium structure with predetermined fixed locations of plumbing, supply and drain lines and electrical and gas services several different kitchen space floor plan configurations are available. This allows the builder the flexibility to alter the position of essential kitchen components, such as a counter top, kitchen sink, oven and stove, as well as other non-essential items such as cabinetry and storage space by pivoting and reconfiguring these components around fixed plumbing service points. In addition, the location of structural components of the kitchen space may be changed as the floor plan configurations are altered.

Additional changes may be made to the condominium structures by adding flex spaces. Flex spaces may be attached to a condominium structure to enlarge and reconfigure certain areas, adapting the condominiums to the needs of the buyers. Each flex space is supported by a foundation and may require the reconfiguration of structural elements within the condominium structure. In some instances the flex space does not require an additional foundation as shown in FIGS. 4, 7 and 10 where the second floor is added to the ranch plan, thus creating a 2 story flex space addition. In other instances the flex space requires an additional foundation to support the additional space. In either example, the base floor plan can be reconfigured before or during the construction phase to accommodate real time buyer demand dynamics.

The present invention allows for both the reconfiguration and addition of living spaces within condominium structures before and during the construction phase. Condominium developments typically consist of a high volume of units, with limited floor plan designs, which are most often already committed to construction or are under construction before buyers are located. Using the present invention, a developer is able to conform, transform and customize a condominium structure in the process of being built, to the specific need of a buyer.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF THE EXEMPLARY EMBODIMENT(S)

Figure 1:
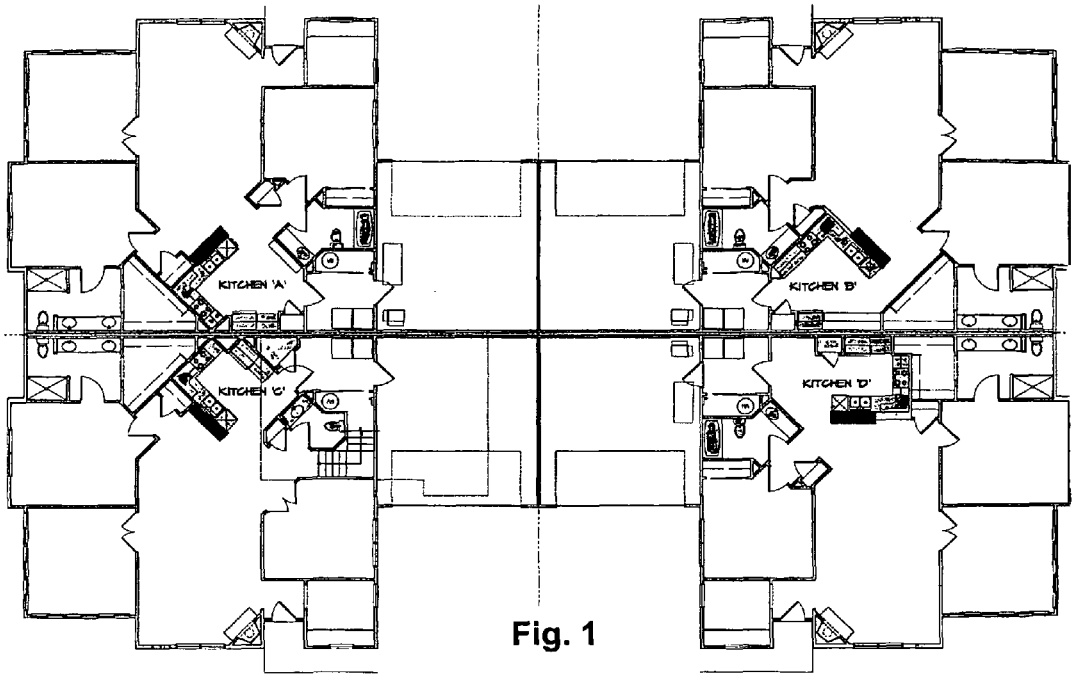
FIG. 1 depicts a plan view of a 4-plex condominium building structure comprised of four condominium units arranged in a pinwheel configuration.

The following invention enables a builder to fix the plat of the condominium building and begin construction on a multi-unit condominium structure while maintaining flexibility on certain design aspects. The invention, in the preferred embodiment, may be incorporated into a multi-unit condominium structure, such as the construction of a 4-plex condominium structure 10 as illustrated in FIG. 1.

The present invention allows for multiple configurations of structural and functional elements within a condominium unit of a multi-unit structure. By using interchangeable space design configurations or modules, a developer may construct multiple floor plans for any one of the condominium units. Although the present invention may be adaptable to any room space or part of a condominium design, for purposes of illustration the following discussion will focus on the adaptability of a kitchen and a bathroom.

In the preferred embodiment, each of the condominium units is constructed on a common or shared foundation having multiple zones 30 whereon each of the units are constructed on one of the zones. The intake (supply) and exit (drain) points of the plumbing system, natural gas, and electrical service busses may be in fixed locations, in each of the zones of the foundation. These fixed locations are preferably the same locations from zone to zone. For example, if a particular toilet drain exit in one unit is located at location x on the foundation plan for that unit, then a neighboring, adjacent unit will have a mirror image toilet drain exit at the same relative location in its foundation plan.

Figure 2:
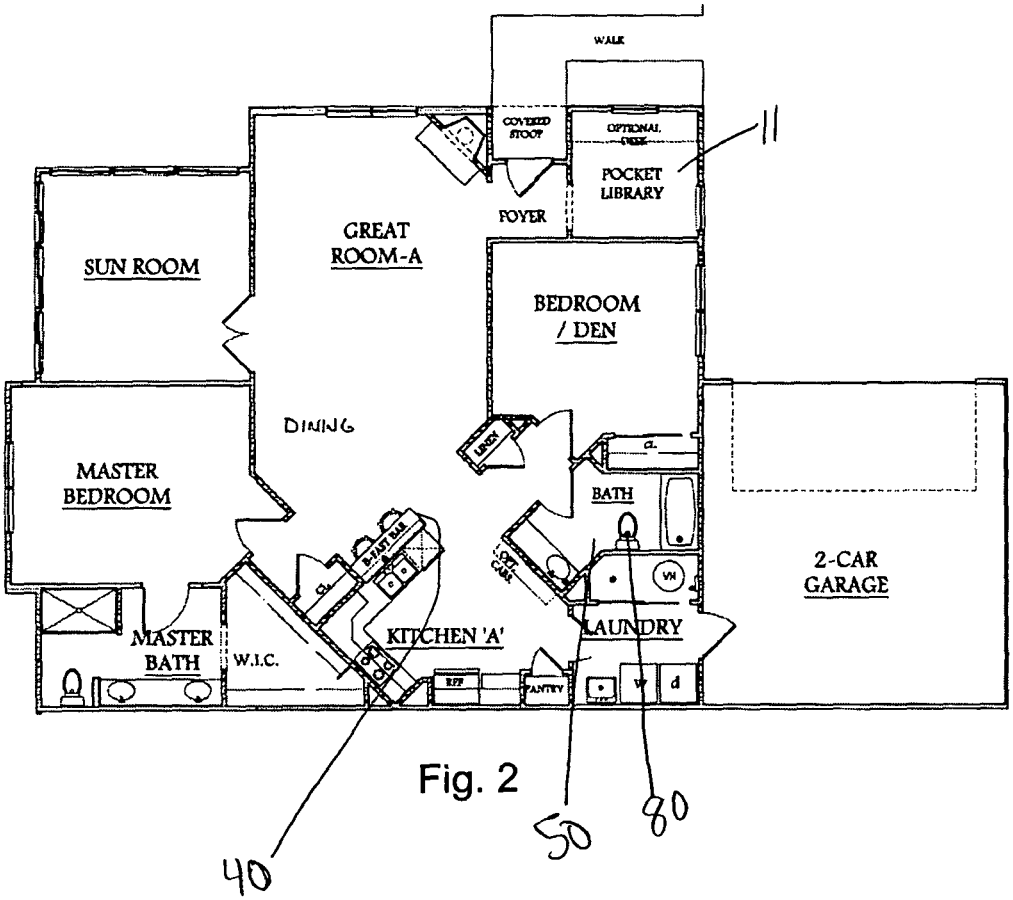
FIG. 2 depicts a plan view of a condominium adapted to form one unit of the 4-plex structure of FIG. 1, with exemplary interchangeable space kitchen layout configuration "A" and a pocket library flex space option.
Figure 3:
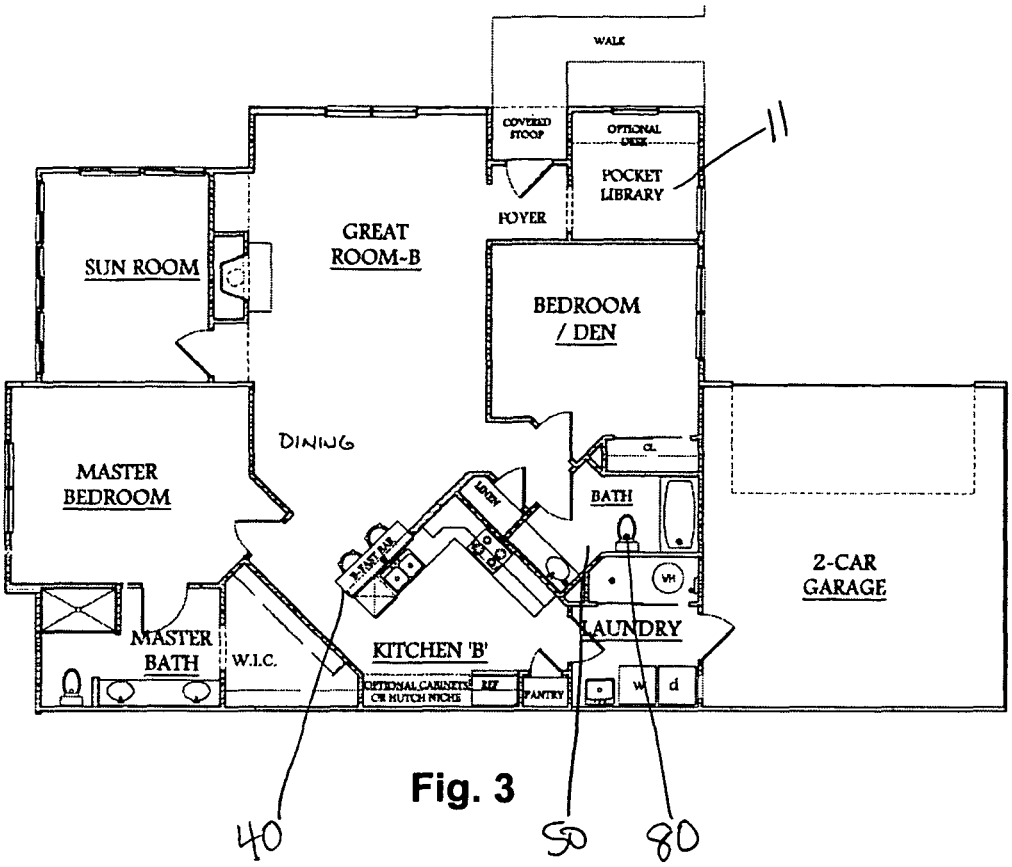
FIG. 3 depicts a plan view of a condominium adapted to form one unit of the 4-plex structure of FIG. 1, with exemplary interchangeable space kitchen layout configuration "B" and a pocket library flex space option.
Figure 4:
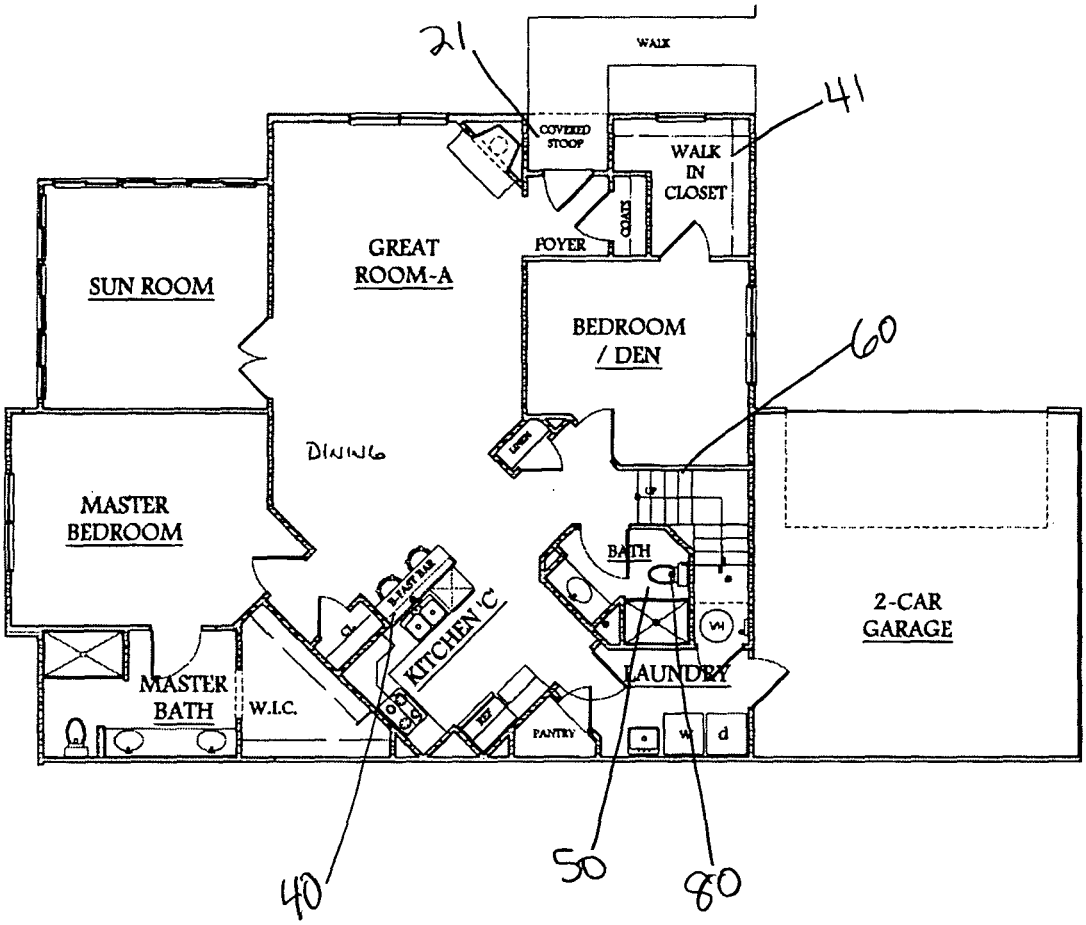
FIG. 4 depicts a plan view of a condominium adapted to form one unit of the 4-plex structure of FIG. 1, with exemplary interchangeable space kitchen layout configuration "C" and a walk-in closet flex space option and a second floor flex space option.
Figure 5:
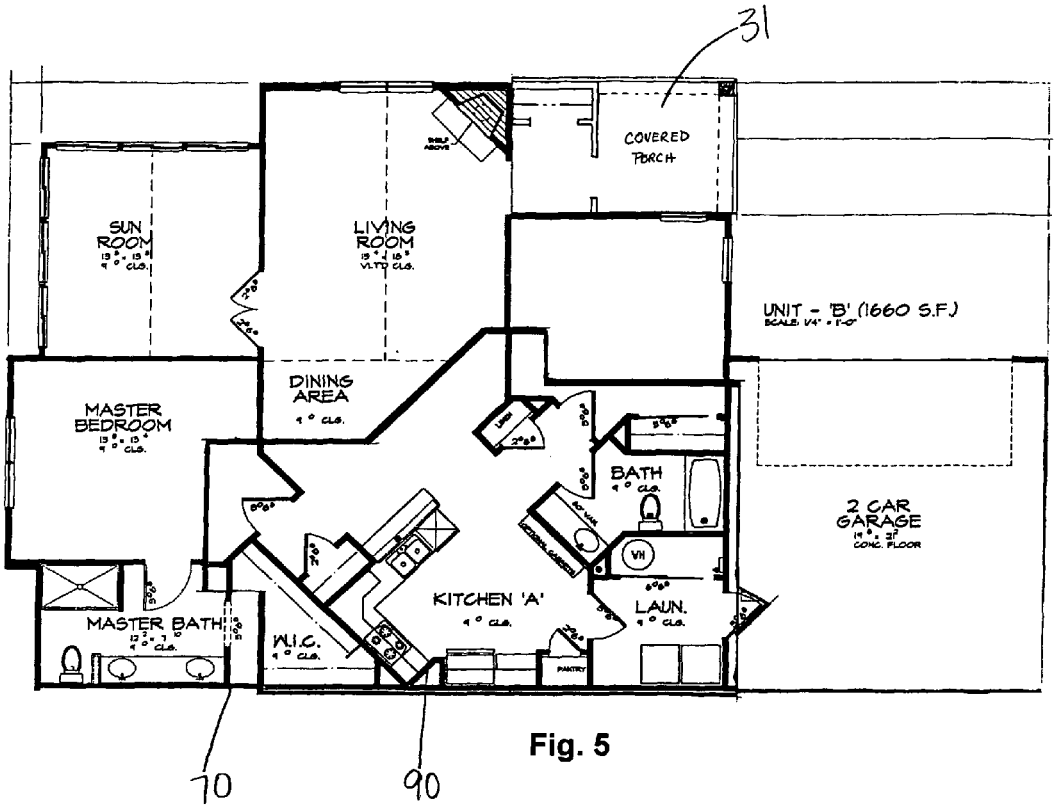
FIG. 5 depicts a plan view of a condominium adapted to form one unit of the 4-plex structure of FIG. 1, with exemplary interchangeable space kitchen layout configuration "A" and a covered porch flex space option.
Figure 6:
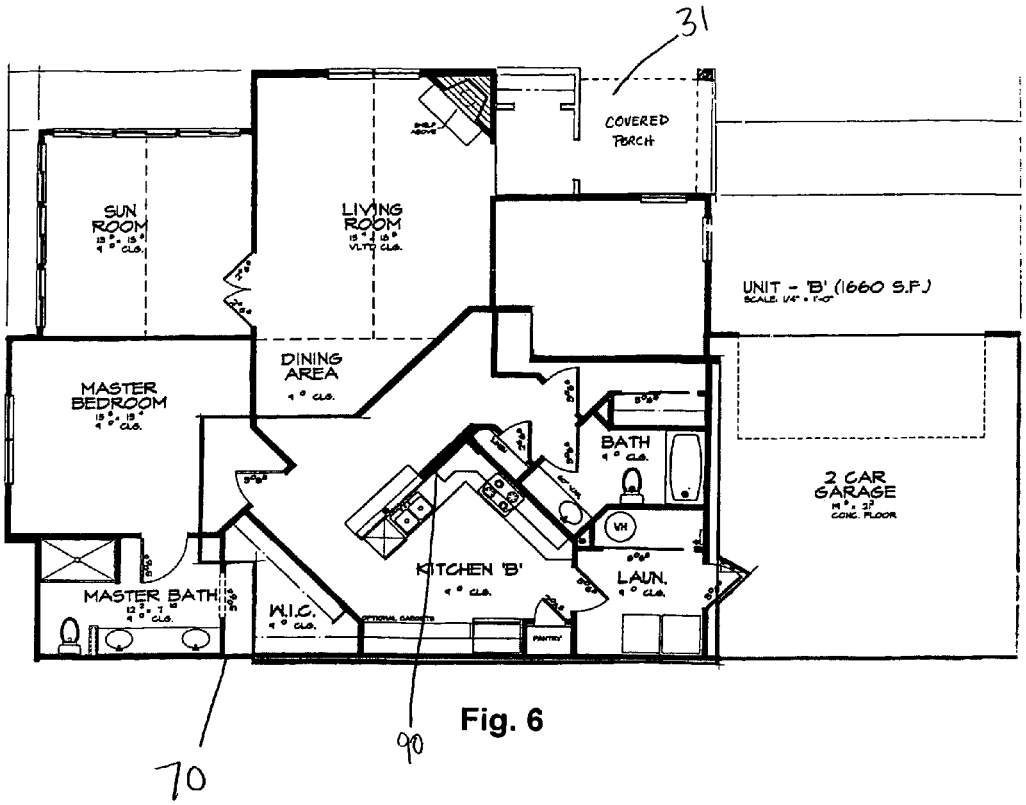
FIG. 6 depicts a plan view of a condominium adapted to form one unit of the 4-plex structure of FIG. 1, with exemplary interchangeable space kitchen layout configuration "B" and a covered porch flex space option.
Figure 7:
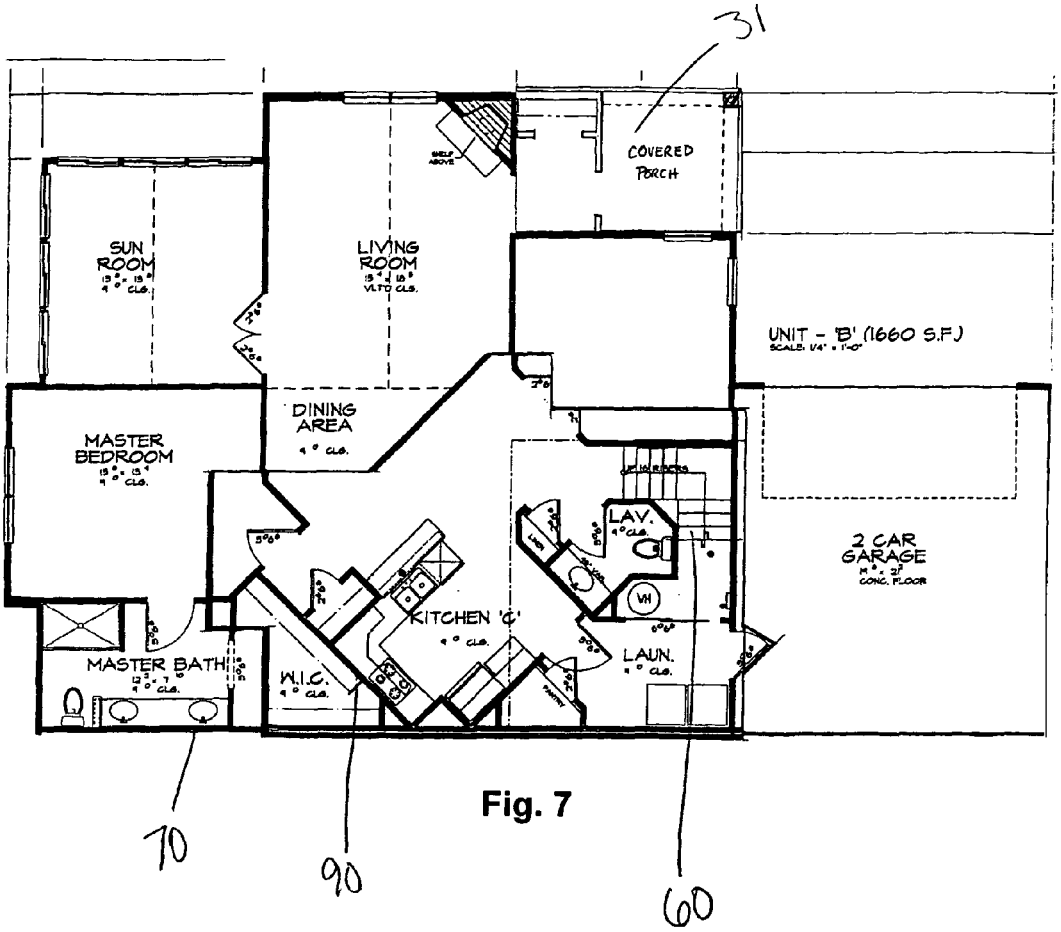
FIG. 7 depicts a plan view of a condominium adapted to form one unit of the 4-plex structure of FIG. 1, with exemplary interchangeable space kitchen layout configuration "C" and a covered porch flex space option and second floor flex space option.
Figure 8:
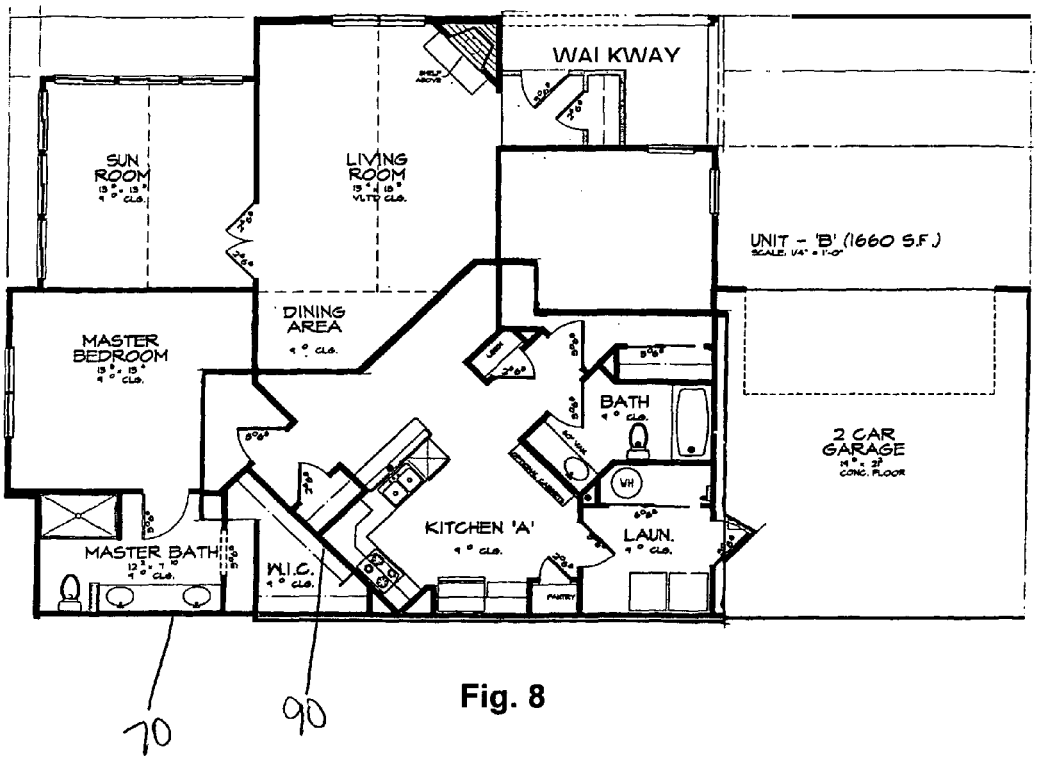
FIG. 8 depicts a plan view of a condominium adapted to form one unit of the 4-plex structure of FIG. 1, with exemplary interchangeable space kitchen layout configuration "A" and a walkway flex space option.
Figure 9:
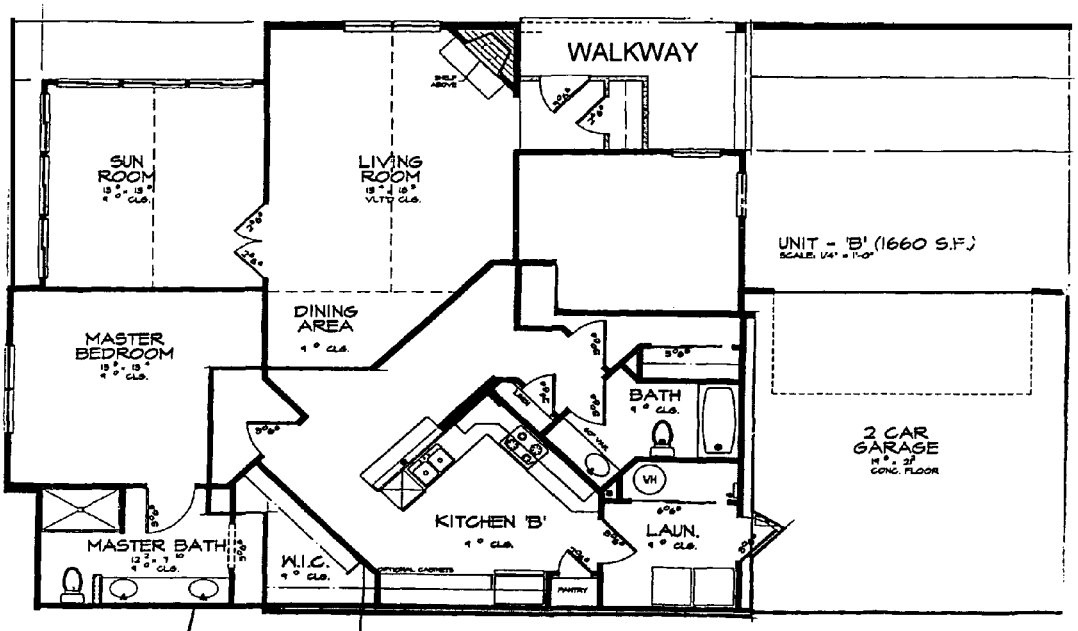
FIG. 9 depicts a plan view of a condominium adapted to form one unit of the 4-plex structure of FIG. 1, with exemplary kitchen layout configuration "B" and a walkway flex space option.
Figure 10:
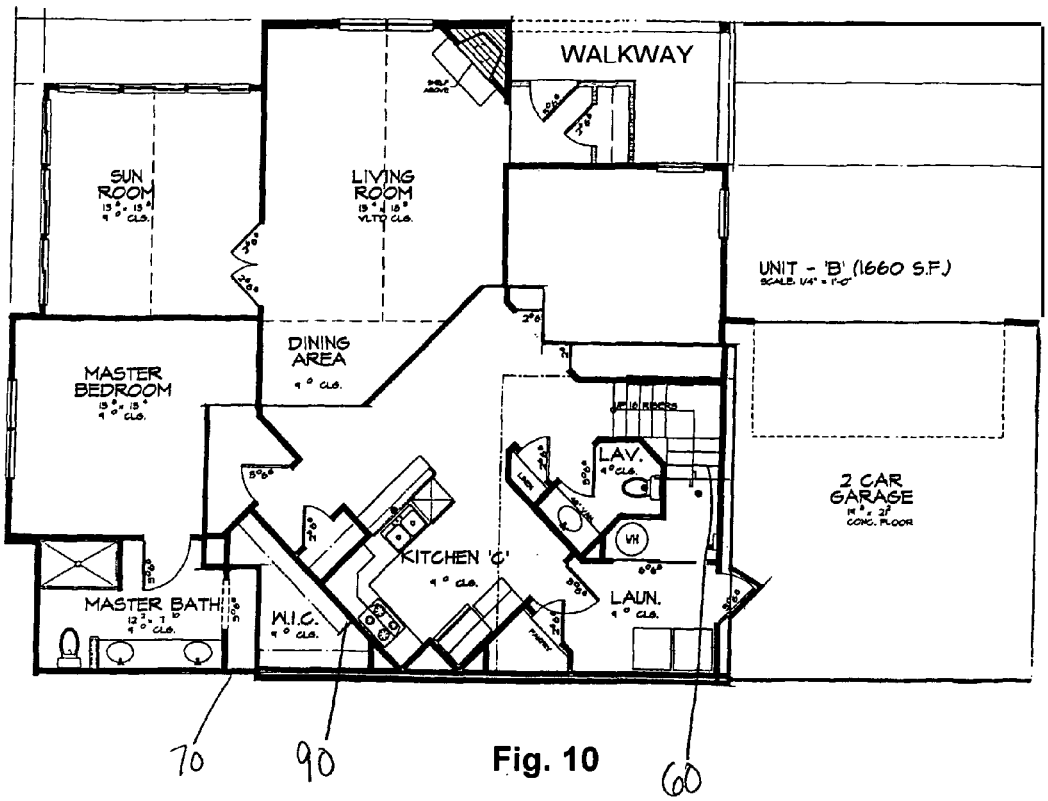
FIG. 10 depicts a plan view of a condominium adapted to form one unit of the 4-plex structure of FIG. 1, with exemplary kitchen layout configuration "C" and a walkway flex space option and a second floor flex space option.
Figure 11:
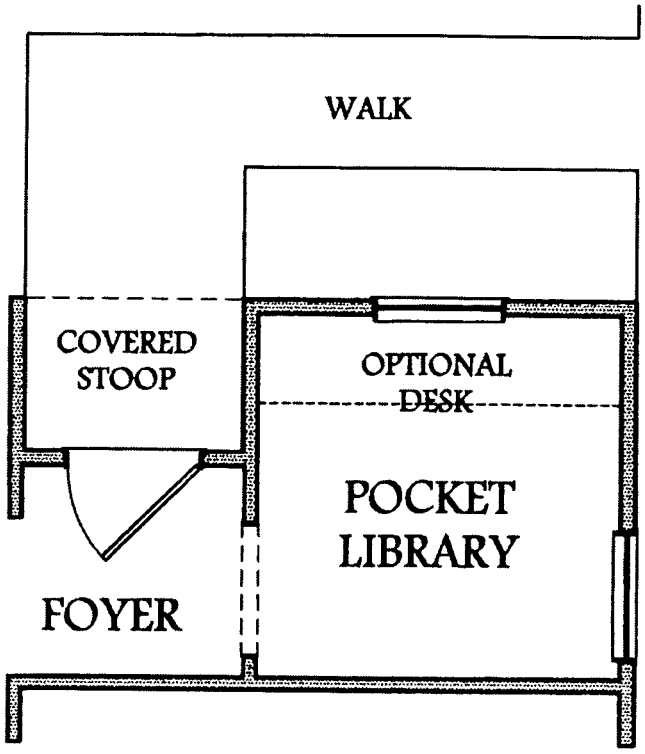
FIG. 11 depicts a plan view of a flex space according to one embodiment of the present invention.
Figure 12:
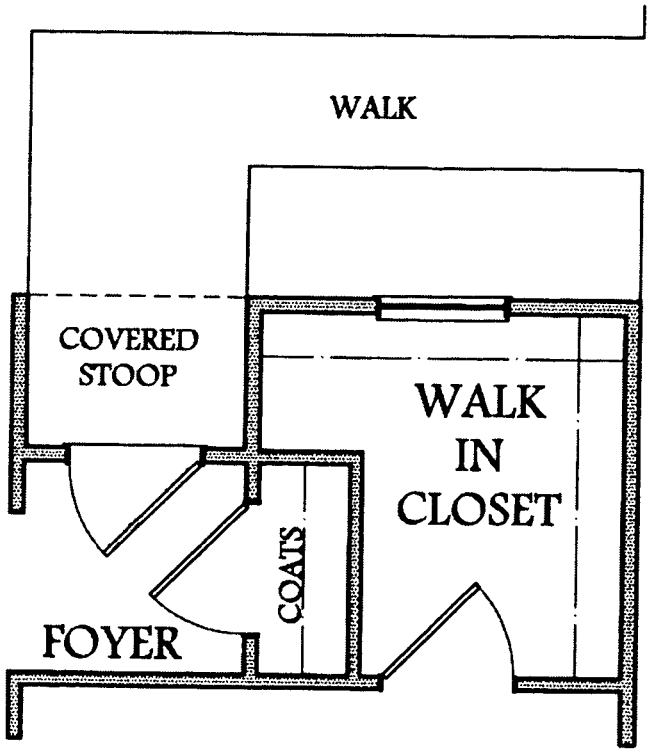
FIG. 12 depicts a plan view of a flex space according to one embodiment of the present invention.
Figure 13:
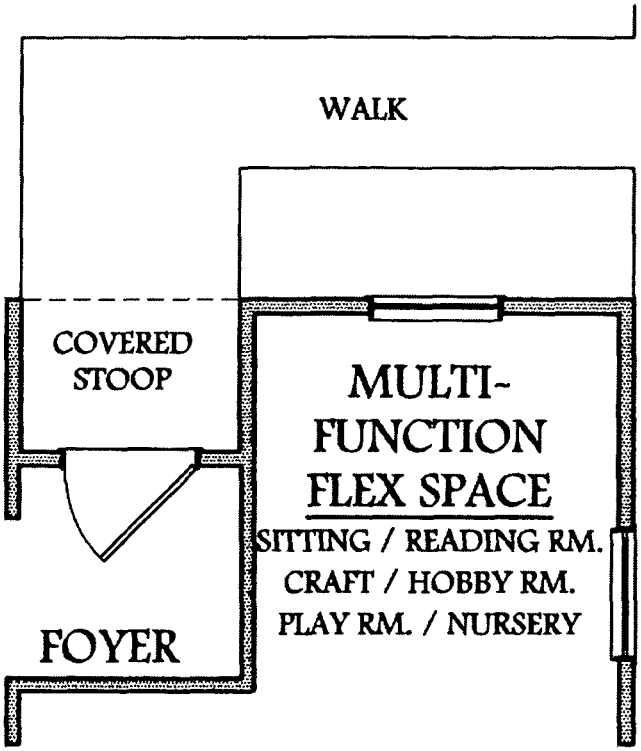
FIG. 13 depicts a plan view of a flex space according to one embodiment of the present invention.
Figure 14:
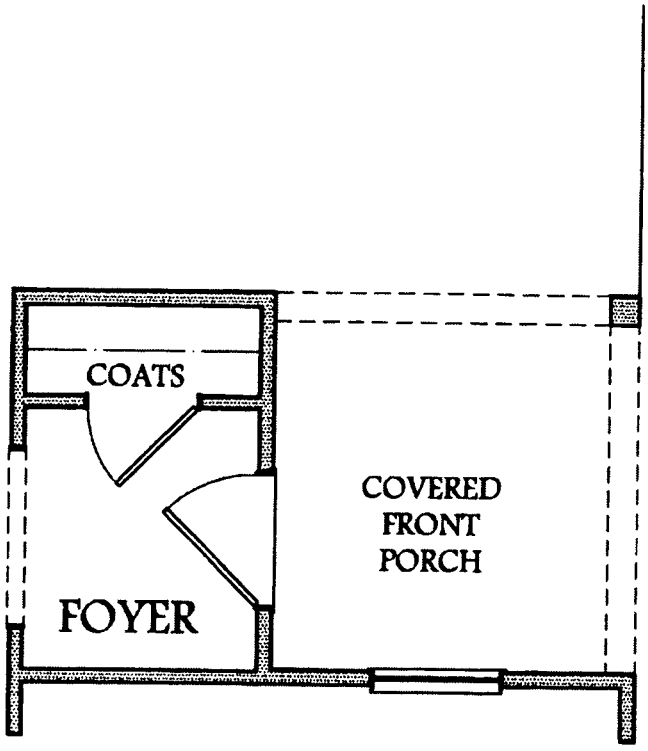
FIG. 14 depicts a plan view of a flex space according to one embodiment of the present invention.
Figure 15:
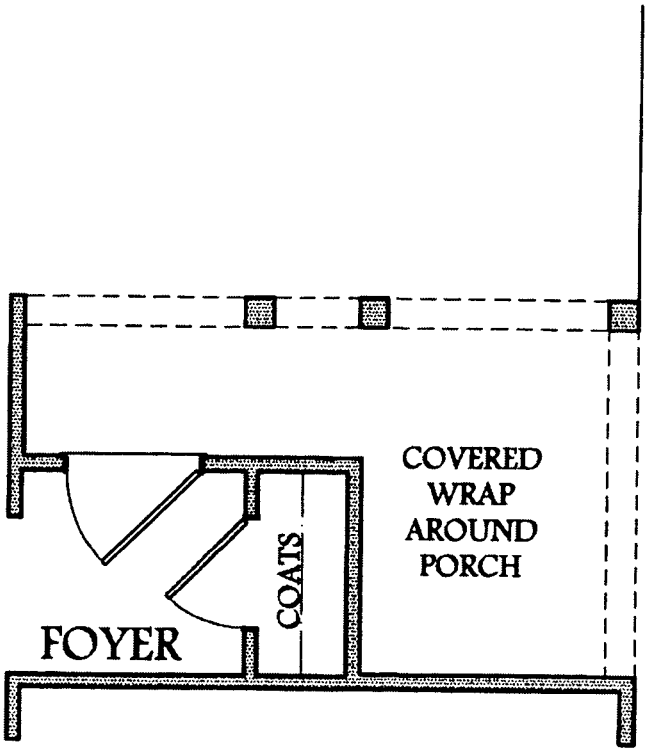
FIG. 15 depicts a plan view of a flex space according to one embodiment of the present invention.
Figure 16:
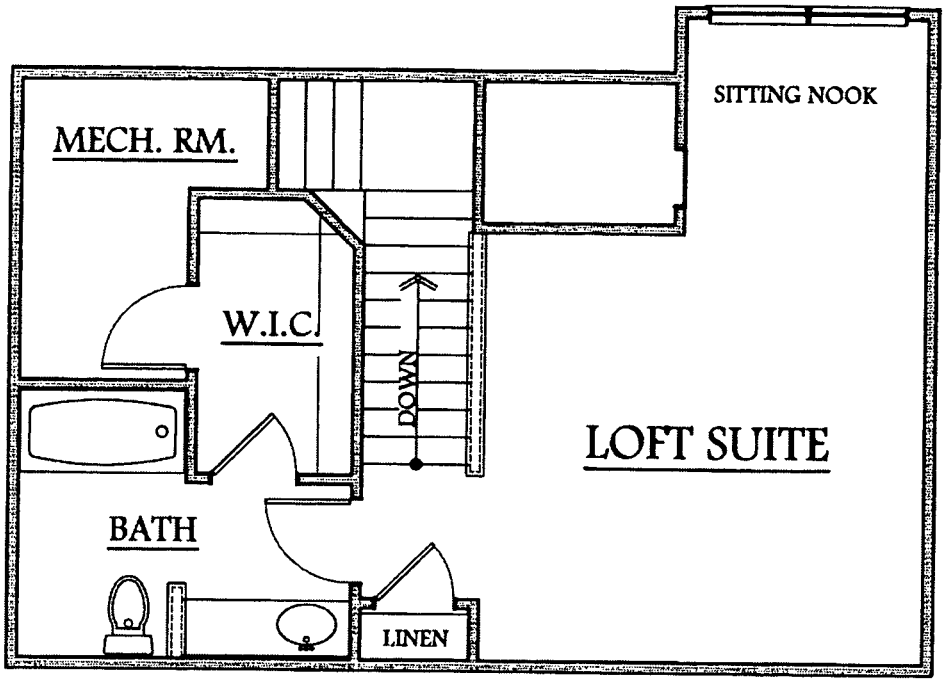
FIG. 16 depicts a plan view of a flex space according to one embodiment of the present invention.
Figure 17:
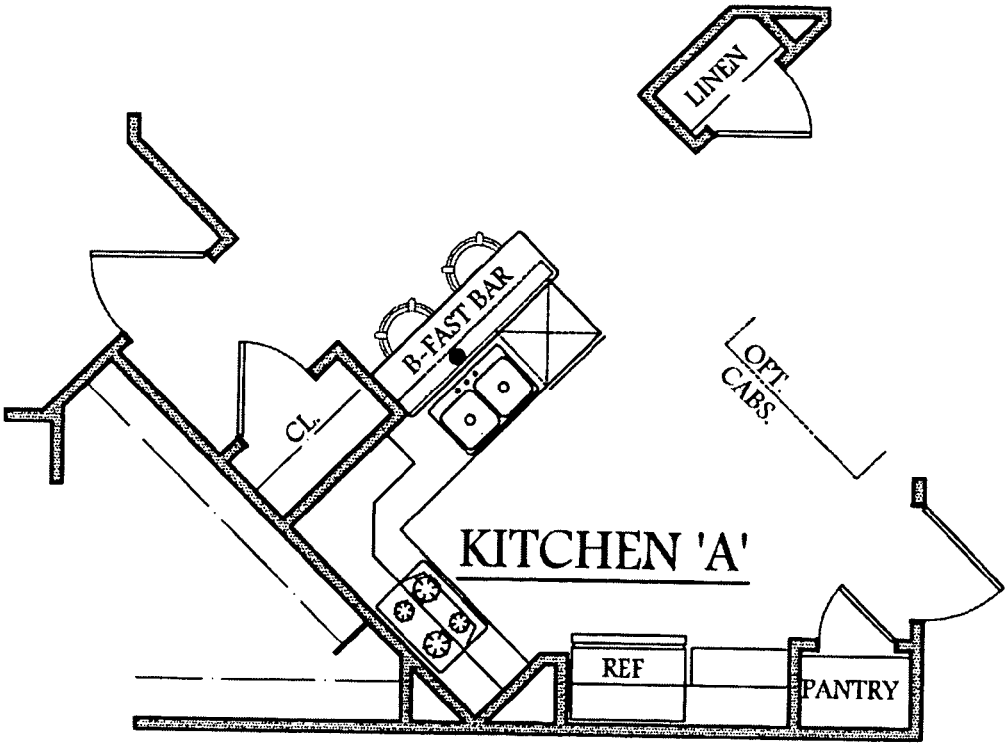
FIG. 17 depicts a plan view of a configurable space according to one embodiment of the present invention.
Figure 18:
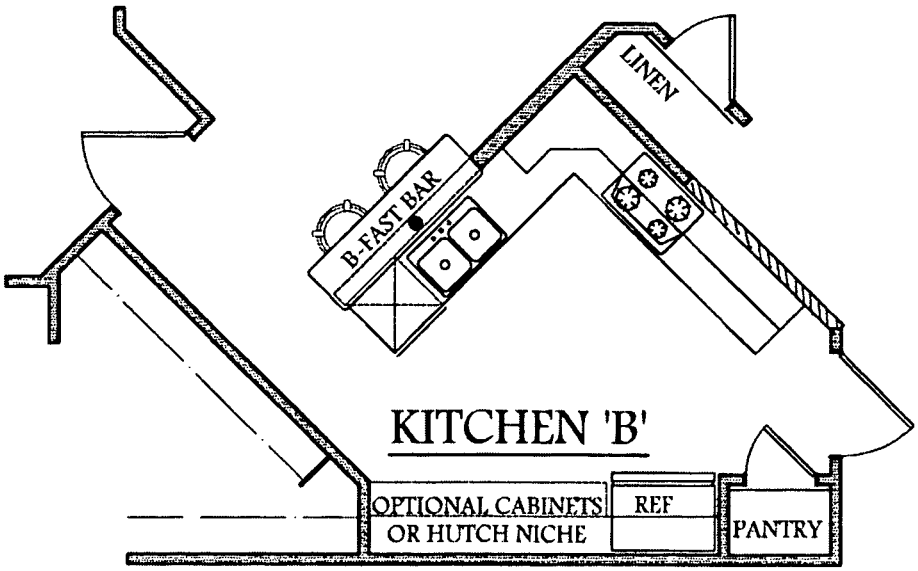
FIG. 18 depicts a plan view of a configurable space according to one embodiment of the present invention.
Figure 19:
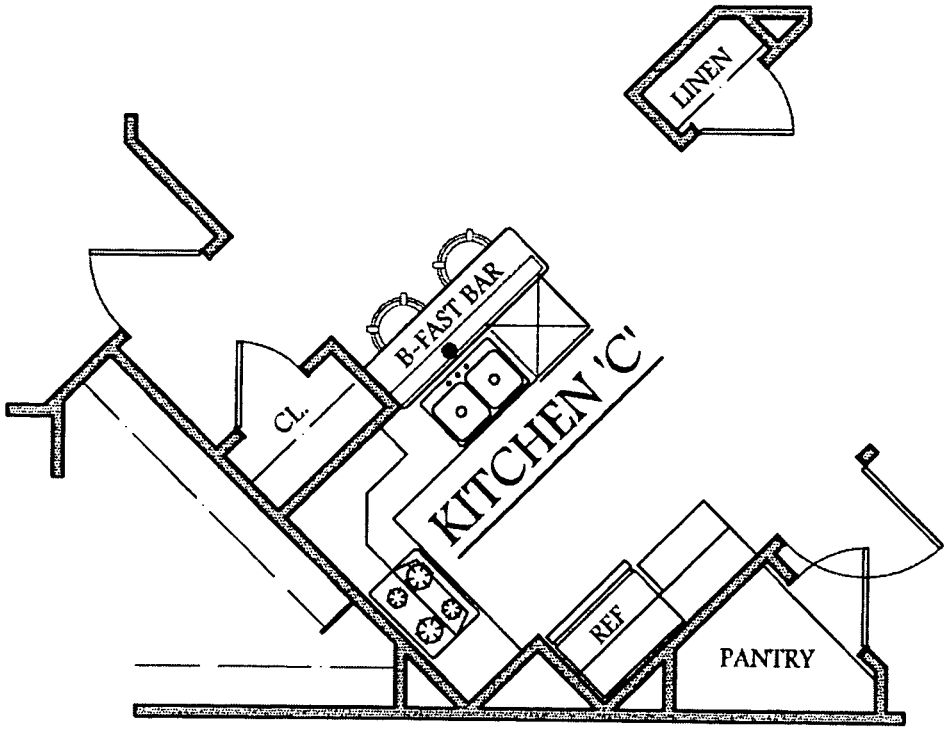
FIG. 19 depicts a plan view of a configurable space according to one embodiment of the present invention.
Figure 20:
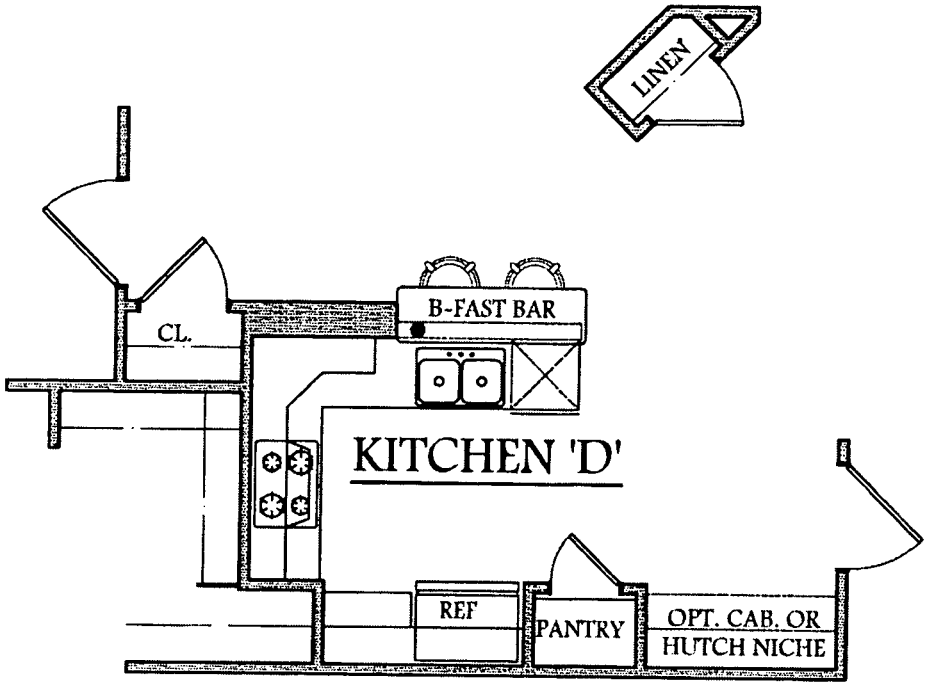
FIG. 20 depicts a plan view of a configurable space according to one embodiment of the present invention.

As will be described herein, a multiplicity of kitchen space configuration options designed around these fixed datum points are employed. Exemplary kitchen layouts A, B, and C depicted respectively in FIGS. 2, 3, and 4 illustrate exemplary options where a peninsula counter top 40, which contains the kitchen sink, and bathroom lavatories 50 may be positioned in a variety of locations, all pivoted around the fixed plumbing datum point within a particular condominium unit while maintaining the same fixed datum points relative to the foundation. Such options are not limited to the horizontal dimension but may also include different elevations. For example, the kitchen layout as illustrated in FIGS. 4, 7, and 10 shows a stairwell 60 adjacent to the lavatory 50 to bring in a second floor level into the unit. Additional alterations may be made by changing the position of the stove and oven, by moving cabinetry, or by adding a pantry closet. The flexibility to select from a variety of different kitchen configurations extends for example, but is not limited to such items as cabinets and countertop configurations. It should be noted that the locations of the structural wall supports 90, indicated in FIGS. 5-10 with darkened lines, may differ with the position of the various kitchen components depending on the kitchen configuration selected.

A similar process may occur for the bathroom layouts. Using set datum points of drainage and supply 80, the builder is able to configure a bathroom space to one of several different configurations. As illustrated in FIGS. 2, 3, and 4, the floor plan of a particular bathroom design may be altered by changing the location or pivoting the orientation of the toilet, sink and/or the shower/bath over these common service datum points. In addition the necessary structural partition of the bathroom may be changed to accommodate the different floor plan configurations.

An essential benefit of the present invention is that the developer is not committed to a particular floor plan until which time the developer chooses to install the necessary kitchen or bathroom equipment and surrounding partition walls. Thus, if the developer so chooses, he may decide to proceed to build the foundation and begin the structural shell of a condominium unit and even complete the structural shell of the condominium unit before a buyer is located and is offered the flexibility to select which design configuration to purchase.

In accordance with a preferred embodiment of the present invention a universal foundation (slab, crawl or basement) may be installed which accommodates more than one combination of distinctly different floor plans, including ranch, story and a half and two story floor plans; or stated differently, a universal foundation 70 is one where different combinations of multiple floor plans can be built on the same foundation.

A universal plumbing design may be a specifically designed underground or above-ground plumbing plan that can be used with more than one foundation and more than one floor plan. Given a specific universal plumbing design, the associated foundations and floor plans may differ in size and dimension; and the kitchens, baths, laundry and other "plumbed" features may differ in configuration; but, the points of collection (e.g., drain lines) and the points of service (e.g., hot and cold water supplies) are designed to be in the same servicing locations. The practice of using a single universal plumbing design for each floor plan in side-by-side and back-to-back adjoining multi family units of similar and dissimilar floor plans, results in adjoining units having mirror imaged plumbing layouts.

A key benefit of the mirror-image-universal plumbing design approach is to simplify the installation of the underground plumbing by reducing the layout time associated with installing each of the underground systems.

The builder may also alter a floor plan configuration through the use of flex space. Flex space may be attached to or incorporated within the floor plan of a particular unit to offer the buyer varied space for their specific needs. Flex spaces may vary in design or they may be of a single universal configuration. They may also require the reconfiguration of the original floor space (i.e. the alteration of walls, doorways, windows or access locations) in order to incorporate the new flex space. Flex space may be attached to any part of a condominium structure, provided that adequate space exists on the exterior of the structure. Flex space may be used to alter the floor plan configuration of any room in a condominium, including the kitchen or bathrooms. FIGS. 2 through 7 illustrate a pocket library 11, covered stoop 21, covered porch 31, or a walk-in closet 41 as optional flex space examples in addition to illustrating the optional kitchen configurations A, B, and C.

FIGS. 11 through 15 illustrate optional flex space options wherein the same size space is utilized with different options such as a pocket library, foyer, and covered stoop combination or a walk-in closet, foyer and covered stoop combination or a multi-functional flex space, foyer, and covered stoop combination or a covered porch, foyer and coat closet combination or a covered wrap around porch, foyer combination.

FIGS. 17 through 20 illustrate optional configurable kitchen space options.

Figure 21:
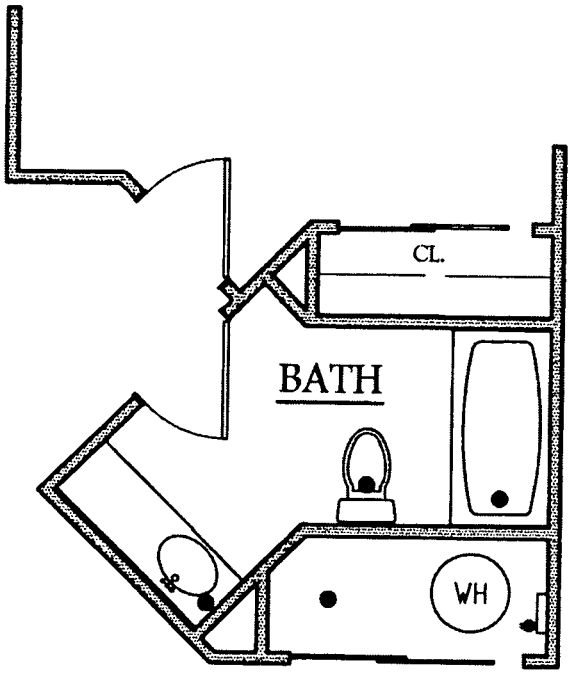
FIG. 21 depicts a plan view of a configurable space according to one embodiment of the present invention.
Figure 22:
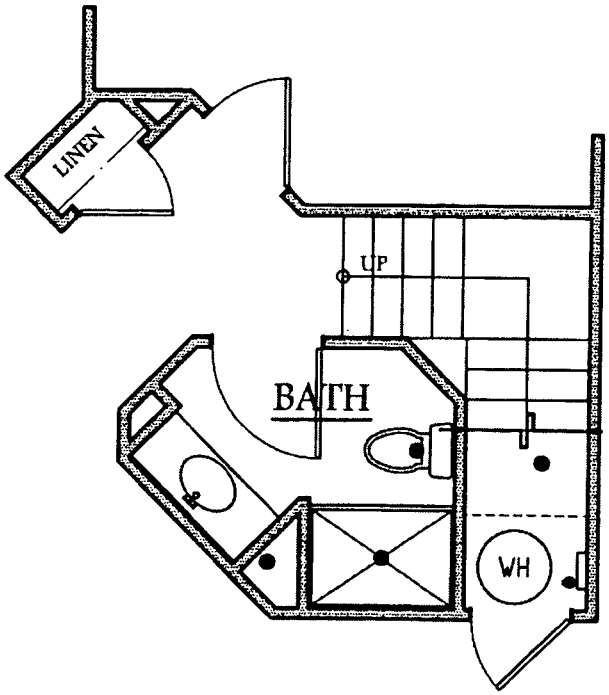
FIG. 22 depicts a plan view of a configurable space according to one embodiment of the present invention.
Figure 23:
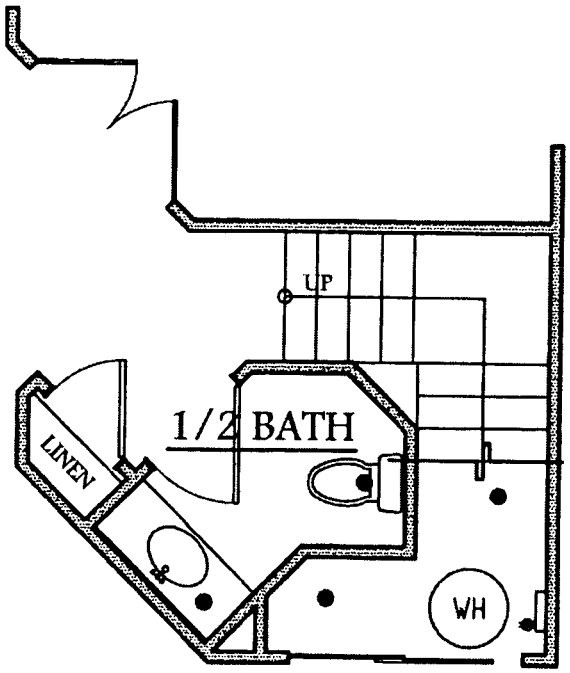
FIG. 23 depicts a plan view of a configurable space according to one embodiment of the present invention.

FIGS. 21 through 23 illustrate optional bathroom space options.

Figure 24:
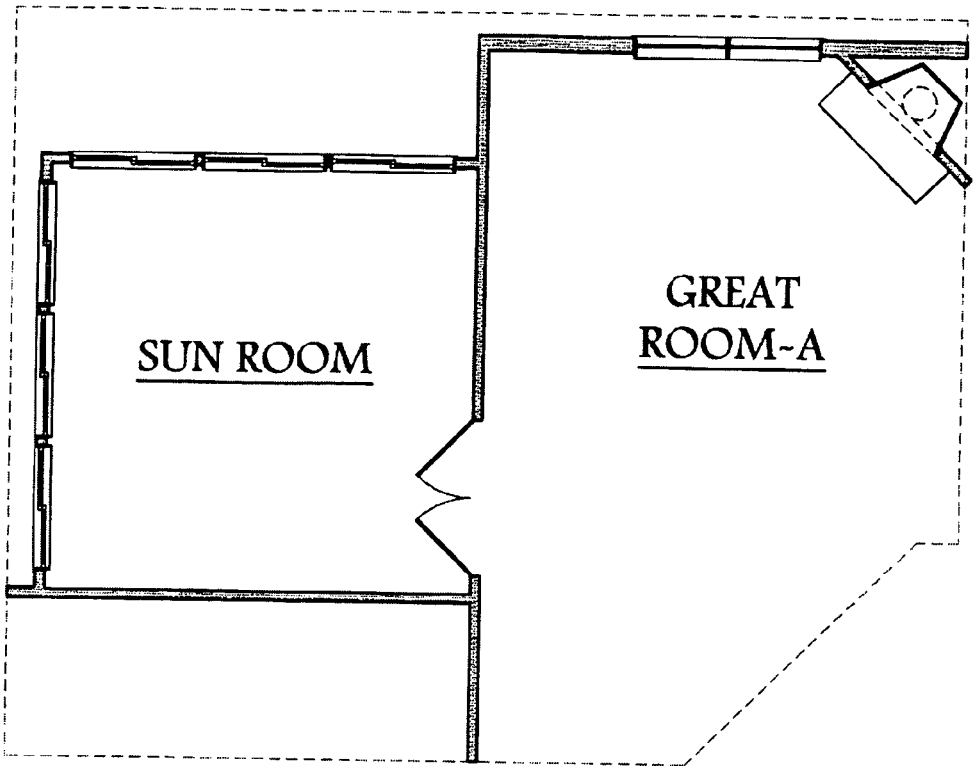
FIG. 24 depicts a plan view of a configurable space according to one embodiment of the present invention.
Figure 25:
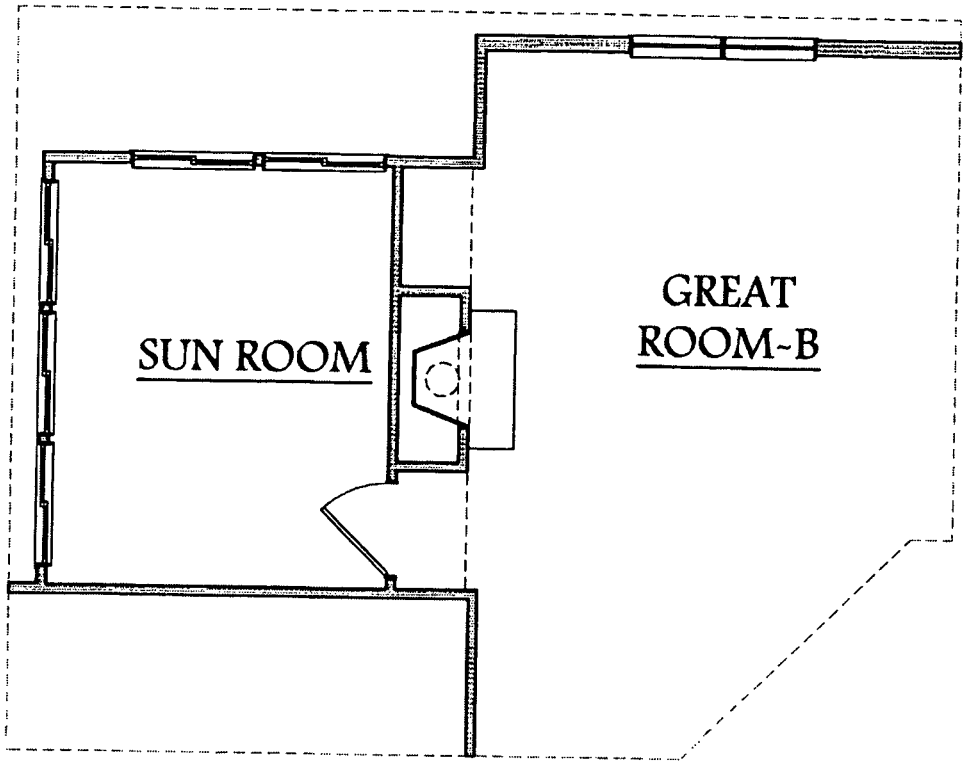
FIG. 25 depicts a plan view of a configurable space according to one embodiment of the present invention.
Figure 26:
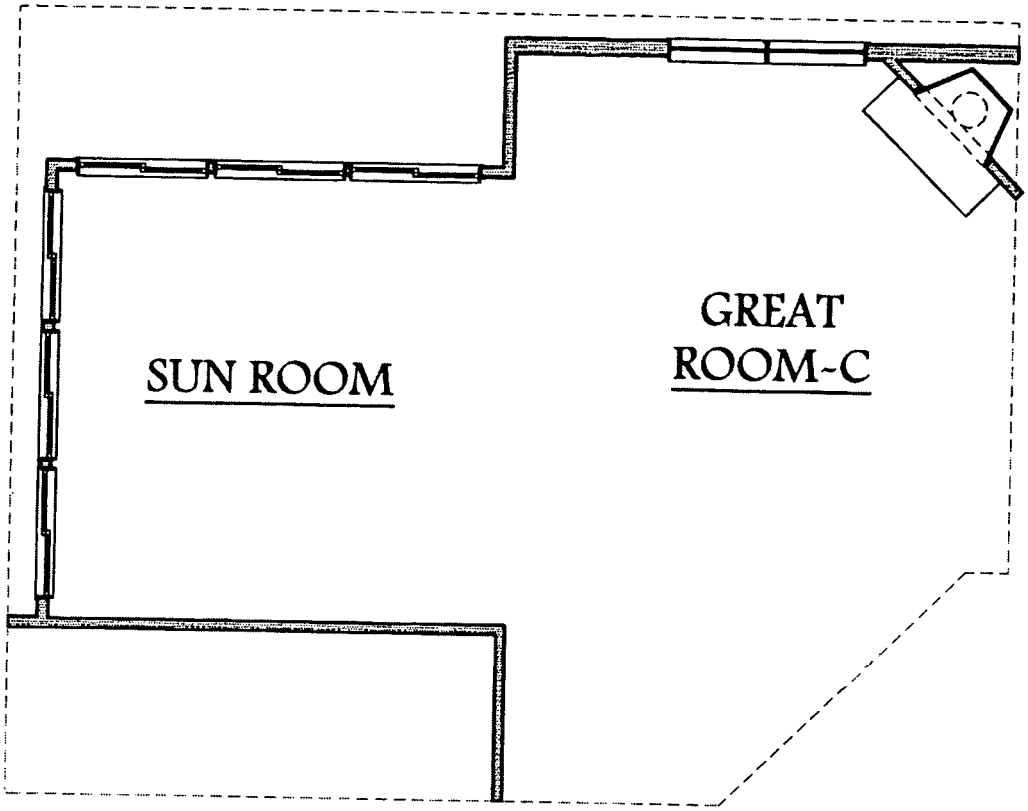
FIG. 26 depicts a plan view of a configurable space according to one embodiment of the present invention.

FIGS. 24 through 26 illustrate additional optional flex space options.

Figure 27A:
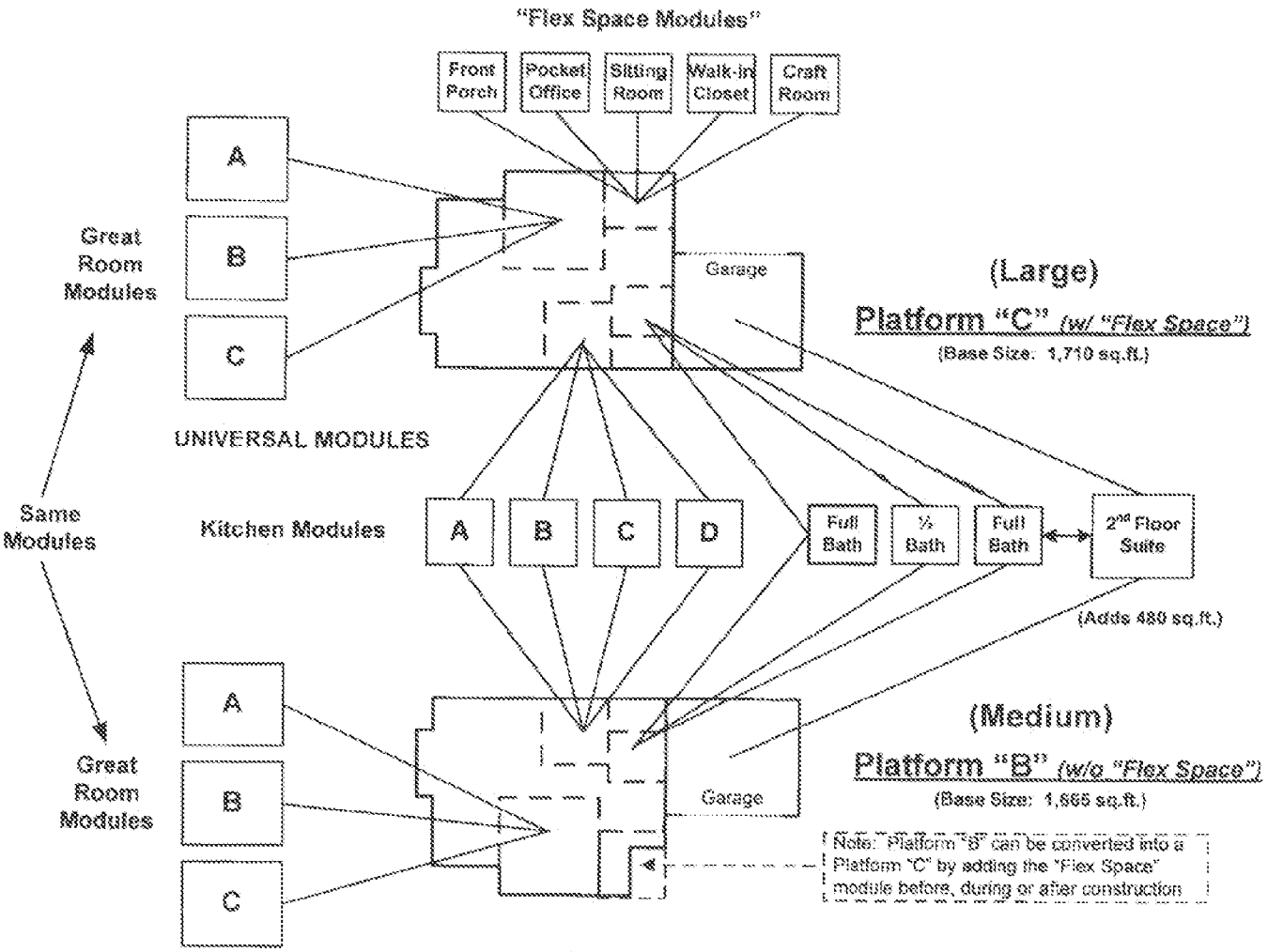
FIGS. 27A and 27B are charts showing the universal modularity of the multi-unit condominiums of the present invention.
Figure 27B:
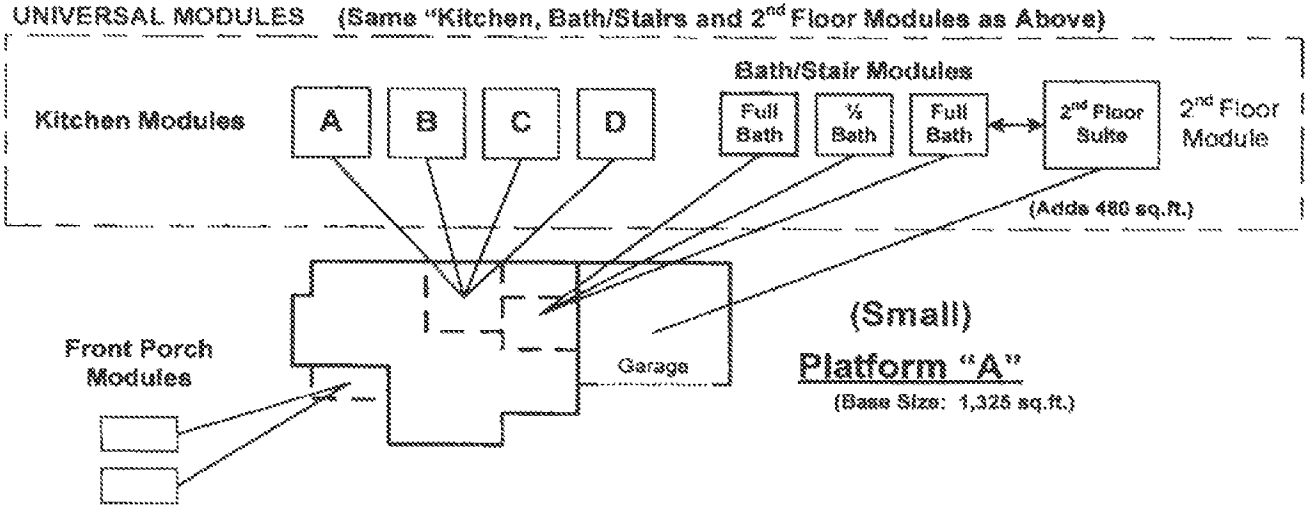

FIGS. 27A and 27B are charts showing the universal modularity of the multi-unit condominiums of the present invention. These charts demonstrate the flexibility and the huge number of options that may be available to a buyer.

Flex space may be added or reconfigured at any time during the construction process and even after the construction of the structural shell for the individual condominium unit has been completed. The flex spaces may be supported by an optional dedicated foundation or be incorporated within the base foundation; however, the developer has at least three options to construct the foundation. The flex foundation may be added to the original foundation while the foundation is being poured. The flex foundation may also be roughed into the foundation, meaning the subsurface portion of flex foundation is poured with the original foundation. If the buyer later chooses to add flex space, the flex foundation may be completed before the flex space is attached. The final option is for the builder to construct the unit foundation without completing any portion of the flex foundation, and to construct the entire flex space foundation if and when the buyer decides to add a flex space unit. The choice of which foundation to build will be determined by the developer's forecasted demand for flex spaces or at the request of an identified buyer, but regardless of the method used the flex space may be attached at any time during or after initial construction.

A unique aspect of the flex spaces is that they may be predetermined by the developer and added to individual units of the multi-unit structure without need of changing the foundation of the original structure. In other words, the flex spaces are designed to work in combination with the unit foundation of the present invention. Buyers can choose from a plurality of predetermined flex spaces to add to whatever unit design they select for their condominium. Or, buyers can elect to add no flex space to their unit.

For example and clarification, in the case of four distinct base floor plans, such as (3) ranch plans (small, medium and large) and (1) story and a half plan, the present invention provides as many as (36) distinctly different configured buildings by mixing and matching the four floor base plans in a 4 unit condominium structure. For example, plans A, B, C and D may be arranged in the following combinations: ABCD, ABCC, ABBC, BBDD, CCCC, CCDD, AADD and so on.

By rotating or mixing them in distinctly different orientations about the pinwheel many combinations may be achieved. For example, a building configured with one each of plans A, B, C and D would count as one unique combination even though the same plans could be rotated or mixed up to be positioned around the pinwheel as ABCD, ABDC, BACD, BCDA, ADCB, BADC and so on; thus, then allowing for 256 different combinations. Adding multiple flex space options results in considerably more combinations.

While certain embodiments of the present invention are described in detail above, the scope of the invention is not to be considered limited by such disclosure, and modifications are possible without departing from the spirit of the invention as evidenced by the following claims.

What is claimed is:

1. A multi-unit condominium building structure, comprising:

a shared foundation, comprising a slab that defines a plurality of unit foundation zones, wherein each of the plurality of unit foundation zones is substantially identical and provides a plurality of common predetermined datum points, with a plumbing system integrated into the slab of each of the unit foundation zones, the plumbing system in each of the unit foundation zones positioned identically relative to the predetermined datum points of the unit foundation zone;

a plurality of condominium units, corresponding to the number of unit foundation zones, each of the plurality of condominium units being supported by a respective one of the plurality of unit foundation zones, wherein each of the plurality of condominium units shares at least one common wall with at least one other of the condominium units of the multi-unit condominium building structure; and a plurality of predetermined space design configurations for at least one space that uses the integrated plumbing system within each of the condominium units, the configuration of the space selected from the plurality of predetermined space design configurations, the multi-unit building structure having at least two different space design configurations.

2. The structure of claim 1, wherein:

the space is a kitchen space.

3. The structure of claim 1, wherein:

the space is a bathroom space.

4. The structure of claim 1, wherein:

at least one of said predetermined space design configurations is a flex space.

5. A multi-unit condominium building structure, comprising:

a 4-plex condominium structure, wherein each of the condominium units is constructed on one of four substantially identical unit foundation zones that provides a plurality of predetermined datum points common to each foundation zone, with a plumbing system integrated into a slab of each of the unit foundation zones, the plumbing system in each unit foundation zone positioned identically relative to the predetermined datum points, with each condominium unit sharing at least one common wall with at least one other of said condominium units in the structure; and a plurality of predetermined space design configurations, wherein the configuration of a space that utilizes the integrated plumbing system within at least one of said condominium units is selected from said plurality of predetermined space design configurations, wherein any one of said plurality of predetermined space design configurations is adapted to function within any one of said condominium units.

6. The structure of claim 5, wherein said space within said condominium unit functions as a kitchen.

7. The structure of claim 5, wherein said space within said condominium unit functions as a bathroom.

8. The structure of claim 5, further comprising a flex space added to one of said condominium units.

9. The structure of claim 5, wherein each of said predetermined space design configurations is adapted to function with the same relative fixed plumbing locations in respective foundation zones for each of said condominium units.

10. The structure of claim 5, wherein said condominium units share a common foundation.

11. The structure of claim 10, further comprising a flex space added to one of said condominium units.

12. The structure of claim 11, further comprising a foundation for said flex space, said foundation constructed at the same time as said shared foundation.

13. A building structure comprising:

a plurality of living units, each of the units constructed on a zone of a shared foundation with plumbing integrated therein, the foundation having as many zones as the number of living units in the structure, the plumbing in each zone positioned identically relative to a plurality of predetermined datum points; and a plurality of configurable space designs for a living space within each unit, said configurable space designs being different floor plans about said plumbing datum points, such that one floor plan uses a first datum point in one manner and another floor plan uses the first datum point in a different manner.

14. The structure of claim 13, wherein said structure is a 4-plex multi-unit condominium structure.

15. The structure of claim 13, wherein said plurality of configurable space designs includes a kitchen living space.

16. The structure of claim 13, wherein said plurality of configurable space designs includes two-story living space.

17. The structure of claim 13, wherein a first one of said plurality of configurable space designs is constructed on a first zone, a second one of said plurality of configurable space designs is constructed on a second zone, and said first one of said plurality of configurable space designs is repeated and constructed on a third zone of said structure.

18. The structure of claim 13, wherein said units have interfacing characteristics resulting in one structure having shared walls and a shared roof upon completion of construction of all of said units in said structure.

19. A method of constructing a multi-unit housing structure, comprising the steps of:

constructing a common foundation, comprising a slab that defines a plurality of unit foundation zones, the plurality corresponding to the number of units in the housing structure, each of the unit foundation zones providing a plurality of common predetermined datum points, with a plumbing system integrated into the slab of each of the unit foundation zones, the plumbing system in each unit foundation zones positioned identically relative to the predetermined datum points of the unit foundation zone; and erecting a housing unit on each of the unit foundation zones, each of the housing units having a floor plan configured from a plurality of predetermined floor plan elements that utilize the integrated plumbing system;

wherein at least one of the erected housing units is configured after completing the common foundation constructing step.

* * * * *